US007757911B2

(12) United States Patent
Barker

(10) Patent No.: US 7,757,911 B2
(45) Date of Patent: Jul. 20, 2010

(54) CONVERTIBLE PACK

(76) Inventor: Robert Marshall Barker, 1770 Remington Rd., Atlanta, GA (US) 30341

( * ) Notice: Subject to any disclaimer, the term of this patent is extended or adjusted under 35 U.S.C. 154(b) by 913 days.

(21) Appl. No.: 11/068,564

(22) Filed: Feb. 28, 2005

(65) Prior Publication Data

US 2005/0194413 A1 Sep. 8, 2005

(51) Int. Cl.
*A45F 3/04* (2006.01)
*A45F 3/02* (2006.01)

(52) U.S. Cl. ..... 224/153; 224/649; 224/647; 224/651; 224/625

(58) Field of Classification Search ..... 224/153, 224/649, 651, 625, 647, 42.11, 250
See application file for complete search history.

(56) References Cited

U.S. PATENT DOCUMENTS

| | | | | | |
|---|---|---|---|---|---|
| 2,919,443 | A | * | 1/1960 | Junzo | 2/94 |
| 3,793,643 | A | * | 2/1974 | Kinoshita | 2/66 |
| 4,408,355 | A | * | 10/1983 | Brock | 2/66 |
| 4,424,841 | A | * | 1/1984 | Smith | 224/240 |
| 4,491,258 | A | | 1/1985 | Jones | 224/153 |
| 4,580,706 | A | * | 4/1986 | Jackson et al. | 224/427 |
| D292,847 | S | * | 11/1987 | Barker | D3/231 |
| 4,862,519 | A | * | 9/1989 | Bull | 2/66 |
| 4,884,731 | A | | 12/1989 | Sibley | 224/215 |
| 4,979,658 | A | | 12/1990 | Baker | 224/153 |
| 5,129,560 | A | * | 7/1992 | Herman | 224/579 |
| D344,184 | S | * | 2/1994 | Barker | D3/231 |
| 5,499,401 | A | * | 3/1996 | Heinmiller | 2/208 |
| 5,586,703 | A | * | 12/1996 | Radar et al. | 224/601 |
| 5,603,441 | A | | 2/1997 | Easter | 224/582 |
| 5,765,733 | A | | 6/1998 | Brule | 224/153 |
| 5,810,230 | A | | 9/1998 | Nutto | 224/417 |
| 5,836,671 | A | * | 11/1998 | Chien | 362/84 |
| 5,890,639 | A | * | 4/1999 | Hancock et al. | 224/429 |
| 6,010,050 | A | * | 1/2000 | Tarr | 224/578 |
| 6,135,333 | A | * | 10/2000 | Tucker et al. | 224/646 |
| 6,189,750 | B1 | | 2/2001 | Von Neumann | 224/153 |
| 6,547,113 | B1 | * | 4/2003 | Hancock et al. | 224/408 |
| 6,672,495 | B2 | | 1/2004 | Sagan | 224/579 |
| 6,786,375 | B2 | | 9/2004 | Worden et al. | 224/627 |
| 7,011,241 | B2 | * | 3/2006 | Godshaw et al. | 224/674 |
| D544,708 | S | * | 6/2007 | Barker | D3/216 |

* cited by examiner

*Primary Examiner*—Nathan J Newhouse
*Assistant Examiner*—Lester L Vanterpool
(74) *Attorney, Agent, or Firm*—Ballard Spahr LLP

(57) ABSTRACT

A pack comprising, in one aspect, a first enclosure and a pair of sleeves. The open end of each sleeve being connected to one respective slit of a pair of slits defined on the exterior surface of the first enclosure such that the pair of sleeves is disposed therein a first interior cavity of the first enclosure to form pockets adapted to receive a user's hands. The pack may also comprise a second enclosure and a shoulder strap connected to portions of the exterior surface of the respective first and second enclosures.

7 Claims, 5 Drawing Sheets

CONVERTIBLE PACK

FIELD OF THE INVENTION

This invention relates to packs, and more particularly a convertible pack suited with a handle to enable the user to carry the pack by hand or convert the pack, via attached straps, to a pack that can be worn on the body for hands free transport.

BACKGROUND

The typical pack, ubiquitous among students, consists of a single unitary pack with external pouches and a zippered, or otherwise securable, main compartment. While these packs can be hand toted, via an attached handle, they are usually carried on the back and generally referred to as backpacks. There are a number of disadvantages to these conventional backpacks. The weight of the pack is unevenly distributed, bringing all the weight to bear on the user's back, which causes a change in the normal center of gravity. The severity of the abnormal gravity shift depends on the weight of the pack. In the case of a small backpacker with a particularly heavy pack, the problem is exacerbated. This shift in the normal center of gravity by use of the conventional backpack causes the user to stand or walk at a forward leaning angle to compensate for the uneven weight distribution. This presents the added disadvantage of promoting poor posture, especially detrimental in the body development of users who have not yet reached puberty.

Not only an ergonomic problem, the eccentric weight of these conventional backpacks presents a safety hazard for cyclists, skaters, skateboarders, or any endeavor where balance is crucial, where a shift in the normal center of gravity may reduce control, and result in an errant maneuver and possibly cause an accident.

Typically, these backpacks are suited with adjustable shoulder straps, the free ends of which are lose and dangling. These loose tailing ends, blind to the user, may become snagged or caught during transport on obstructions or protruding objects, such as the hand rail at the top of a set of steps, resulting in an unforeseen jerk or even an accident.

Aside from the discomfort, health and safety considerations, the conventional backpack lacks utility in that, when worn on the back, the pack is neither visible to the eye nor are the contents accessible by the hand. In order to retrieve an article from the pack, it must first be removed, brought into sight and perhaps unzipped, if the article of interest in within the sealed compartment. Additionally, lacking a chest portion, these conventional packs fail to provide chest or hand protection to comfort the user during cold, rainy or inclement weather. Other design flaws, drawbacks and disadvantages of these conventional backpacks are remedied by the pack of the present invention that can be converted to a body pack.

SUMMARY

In one aspect, the pack of the present invention comprises a first enclosure and a pair of sleeves. The first enclosure has a front panel and an opposed back panel with a side panel disposed therebetween. The first enclosure further has an exterior surface which defines a first interior cavity and a pair of slits. Each sleeve has an open end and defines an interior volume. The open end of each sleeve is connected to one respective slit of the pair of slits such that the pair of sleeves are disposed in the first interior cavity of the first enclosure. Each attached sleeve forms a pocket that is adapted to receive a user's hand. In a second aspect, the pack further comprises a second enclosure and a shoulder strap connected to portions of the exterior surface of the respective first and second enclosures.

Briefly described, in its preferred form, the present invention comprises a pack for carrying articles that can be toted by hand in a conventional manner by an attached handle, or quickly and easily converted to a pack that is carried on the body in a manner that overcomes all of the aforementioned disadvantages of the prior art. In the tote or "hand carry" position, this pack resembles a conventional backpack in that it appears to have a main body portion and a carrying handle. The shoulder strap, externally visible on a conventional backpack, is concealed. The main body of the pack of the present invention is bifurcated into two first and second enclosures that can be co-joined by conventional complimentary hook and loop fasteners attached to each juxtaposed abutting back panels of the respective first and second enclosures. When the enclosures are separated, or pulled apart, the shoulder strap is revealed. In one aspect, the strap is attached to a top portion of each enclosure, much like a saddlebag.

Additional aspects of the invention will be set forth, in part, in the detailed description and Figures which follow, and in part will become obvious from the detailed description, or may be learned by practice of the invention. It is to be understood that both the foregoing general description and the following detailed description are exemplary and explanatory only and are not restrictive of the invention as disclosed.

DETAILED DESCRIPTION OF THE FIGURES

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
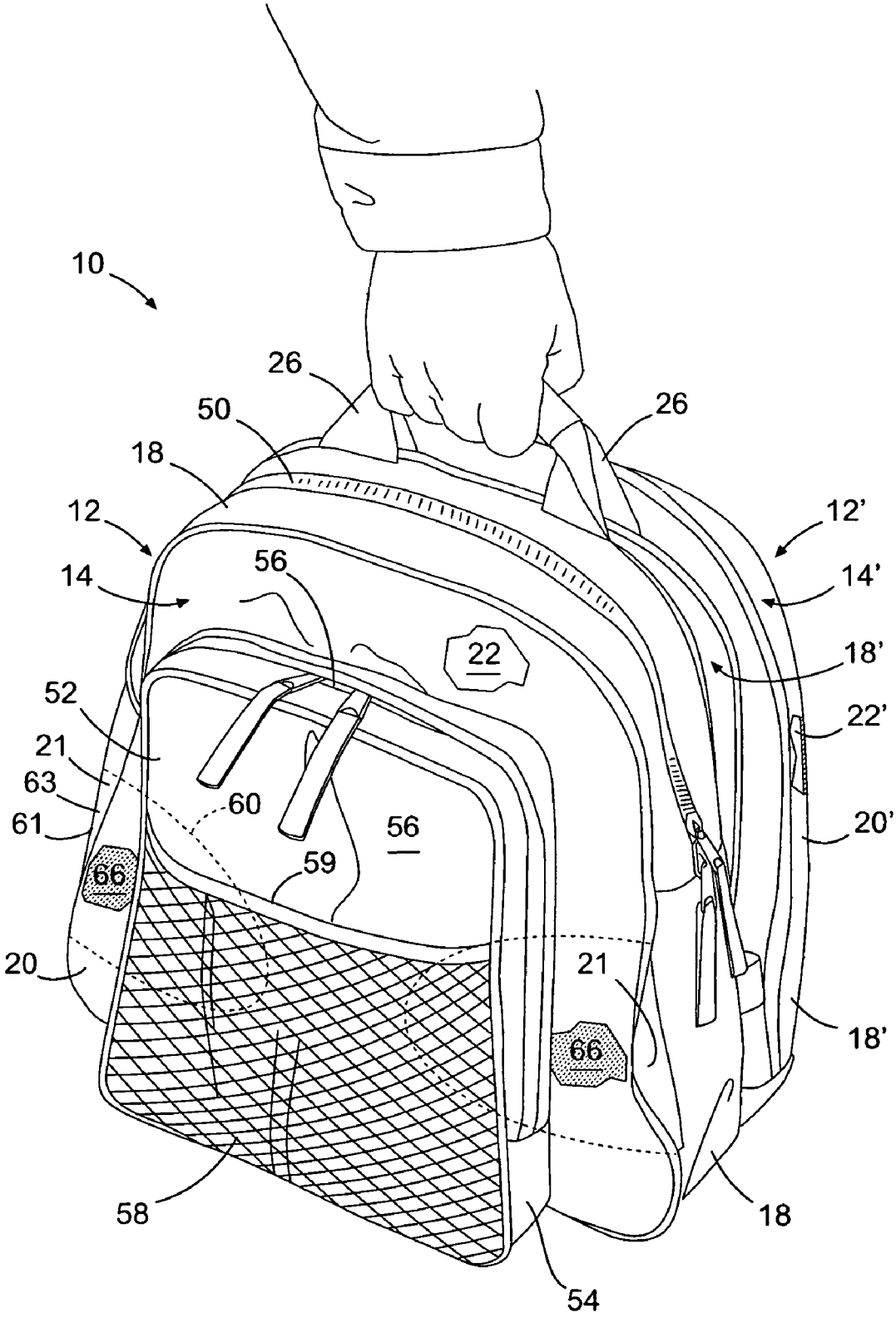
FIG. 1 is a perspective view of the pack being carried in the tote configuration and showing a fragmentary portion of a hand grasping a handle.

The present invention is more particularly described in the following exemplary aspects that are intended as illustrative only since numerous modifications and variations therein will be apparent to those skilled in the art. The exemplary aspects are now described with reference to the figures, in which like reference characters indicate like parts throughout the several views.

Before the present articles, compositions, devices, and/or methods are disclosed and described, it is to be understood that this invention is not limited to the specific articles, devices, and/or methods disclosed unless otherwise specified, as such may, of course, vary. It is also to be understood that the terminology used herein is for the purpose of describing particular aspects only and is not intended to be limiting. Throughout this application, where patents are referenced, the disclosures of these patents, in their entireties, are hereby incorporated by reference into this disclosure.

As used herein, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

There has thus been outlined, rather broadly, the more important features of the invention in order that the detailed description thereof that follows may be better understood, and in order that the present contribution to the art may be better appreciated.

Referring to the figures, in one aspect, the pack 10 of the present invention is separable into a first enclosure 12 and a second enclosure 12'. Each enclosure has a front panel 14, a back panel 16, and a side panel 18 disposed therebetween. Each enclosure has an exterior surface 20 and defines an interior cavity therein, i.e., a first interior cavity 22 and a second interior cavity 22'. As one will appreciate, each of the enclosures are selectively openable such that the respective interior cavity is selectively accesable. The first and second enclosures are mechanically connected, for example, by stitching, fasteners, adhesives, and the like, to a shoulder strap 24. The shoulder strap may be padded for cushioning the weight of the enclosures when carried on the shoulder. In one aspect, the shoulder strap extends therebetween a portion, such as, for example, a top portion 13, of the first enclosure 12 and a portion, such as, for example, a top portion 13', of the second enclosure 12' such that the back panel 16 of the first enclosure can rest on the front portion of the user's body and the back panel 16' of the second enclosure rests on the back portion of the user's body.

In one aspect, the shoulder strap has a fold seam located at a midpoint between its connections to the first and second enclosures. This seam allows the strap to be neatly folded, stored and concealed between the two enclosures when they are converted to the tote or "hand carry" position. The pack may be carried in complete comfort with the weight balanced and evenly distributed upon the user's back and chest.

At least one of the first and second enclosures can have a handle 26 mounted to a top portion of the enclosure. In one aspect, each of the respective enclosures has a handle and the handles are positioned in a complementary and opposed fashion. The handles 26 act in tandem as an unitary carrying handle when the pack 10 is configured as an unitary pack, shown in FIG. 1.

Figure 2:
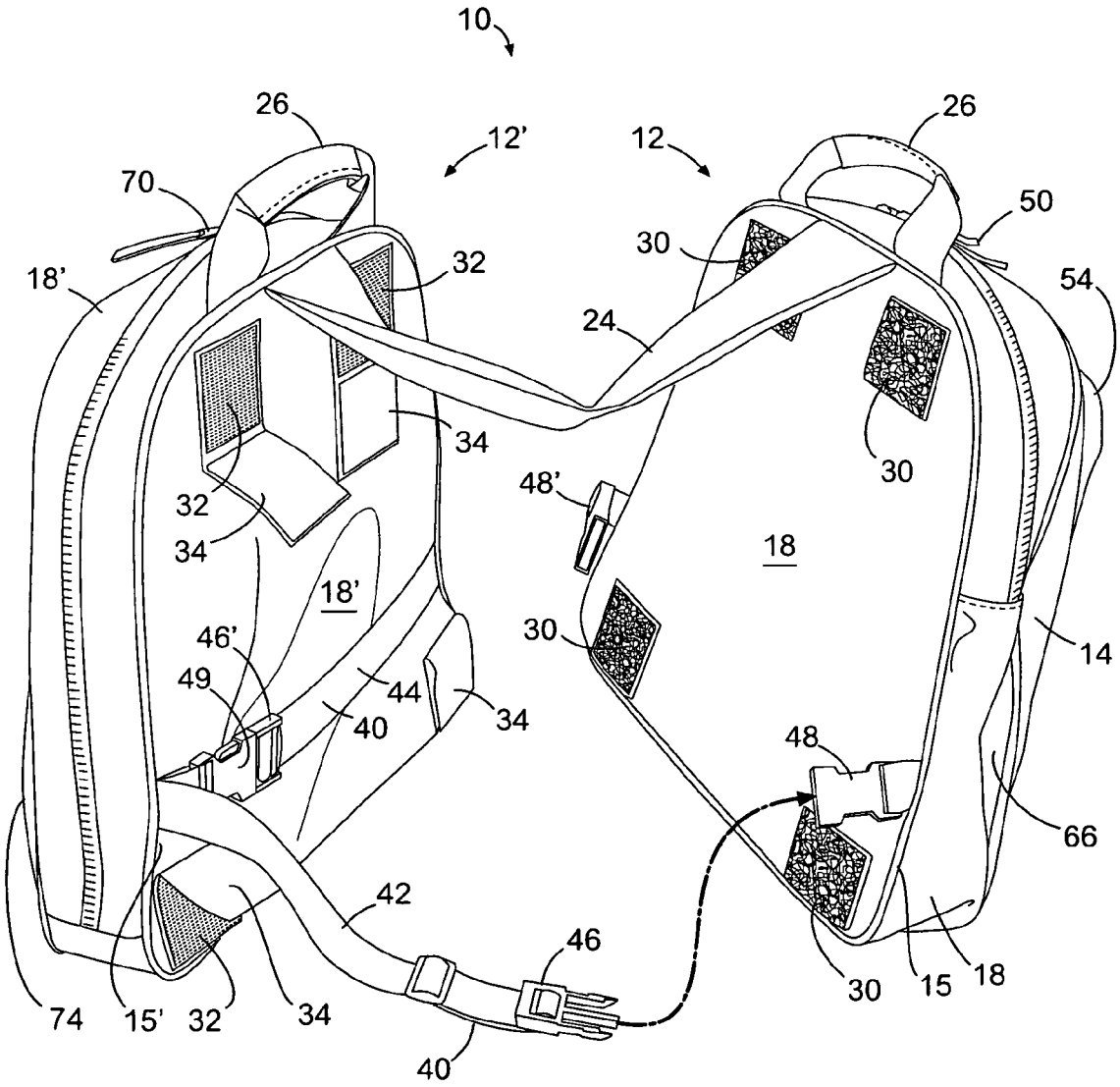
FIG. 2 is a side perspective view of the pack pulled apart in preparation of configuring the pack for a shoulder carry, and showing the juxtaposed abutting back panels of the first and second enclosures.

As shown in FIG. 2, in one aspect, the back panel 16 on the first enclosure has a plurality of loop fastener pads 30 mounted thereon that correspond and mate with a set of complimentary hook fastener pads 32 mounted thereon the opposed back panel of the second enclosure. As one will appreciate, when the first and second enclosures are brought into abutting engagement, the hook and loop fasteners releaseably connect to form the "unitary" pack 10. Each hook pad can also comprise a foldable flap 34 constructed and arranged to fold over the hook pads 32. The flap 34 can have loop material mounted thereon and can be folded over to engage each hook pad to cover the hooks when the pack is shouldered. This prevents the hooks from snagging and marring any material or fabric worn by the packer.

Also interior to the "unitary" pack and attached to the respective back panels of the enclosures, are adjustable side straps 40. In one aspect, a first side strap 42 is mounted to a lower portion 15' of the exterior surface of the second enclosure. A first male coupling 46 is mounted to the distal end of the first side strap. A first female coupling 48 is mounted to a lower portion of the exterior surface of the first enclosure.

Figure 4:
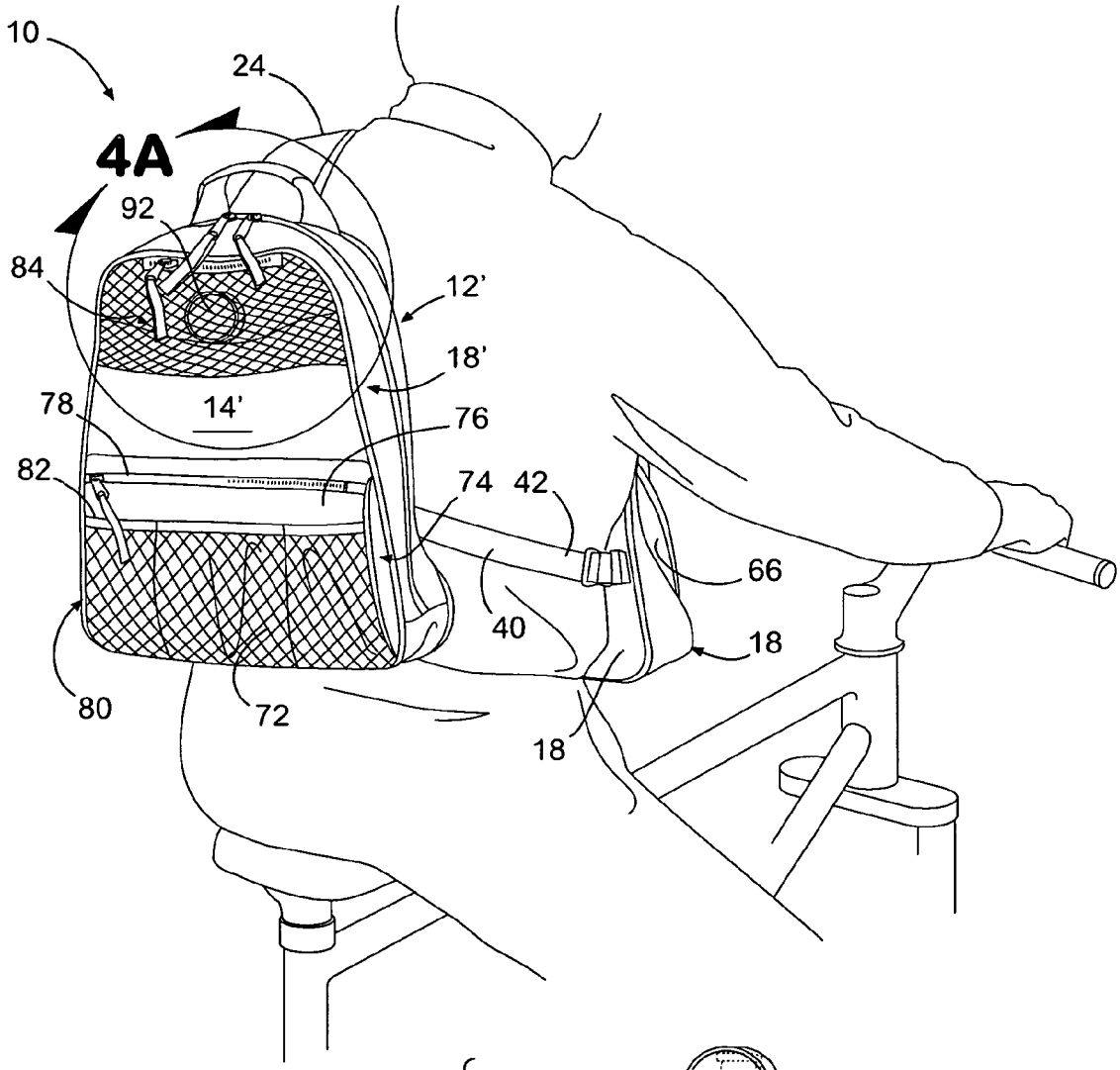
FIG. 4 is a rear perspective view of the pack in the shoulder carry configuration with one side strap fastened to a packer who is in transport on a bicycle during a lighted condition.
Figure 4A:
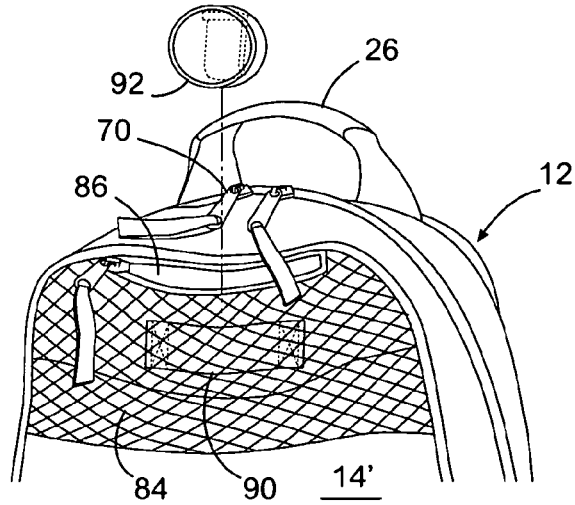
FIG. 4A is a detail view taken from inset circle 4A in FIG. 4 and shows a loop within a mesh pouch for securing a safety light by its clasp.
Figure 5:
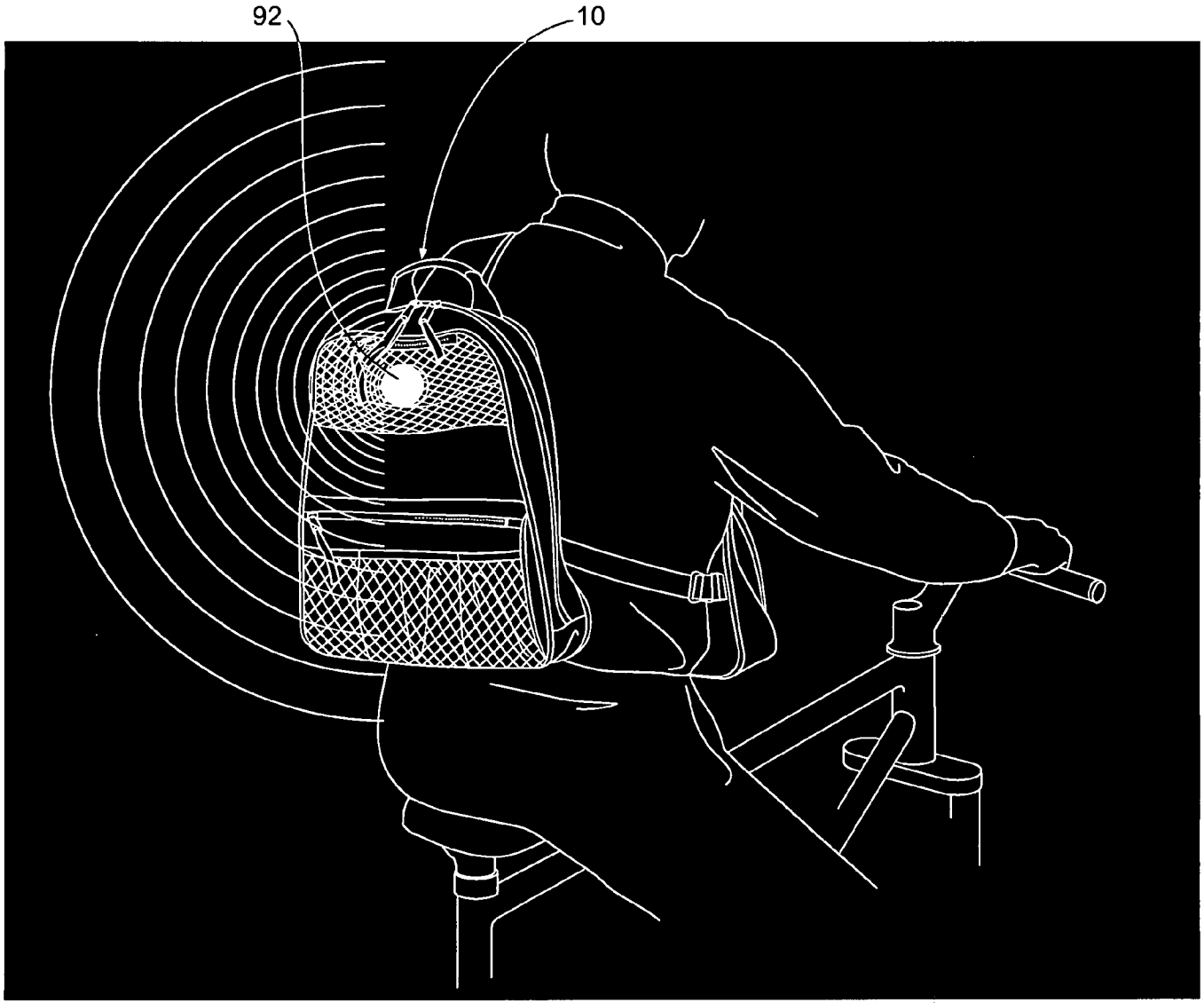
FIG. 5 is a rear perspective view, similar to the view of FIG. 4, dramatically showing the light in the on position during an otherwise unlit condition of darkness.

Similarly, in an alternative aspect, a second side strap 44 is mounted to the lower portion 15' of the exterior surface of the second enclosure and a second male coupling 46' is mounted thereon the distal end of the second side strap. In this aspect, the second side strap is mounted on the opposite side of the second enclosure relative to the first side strap. Further, a second female coupling 48' is mounted to the lower portion of the exterior surface of the first enclosure on the opposite side of the second enclosure relative to the first female coupling. In an alternative aspect, a third female coupling 49 is mounted proximate to the proximal end of the first side strap 42 for selective connection to the second male coupling such that the second side strap may be stored when not in use. As one will appreciate, the male and female couplings are constructed and arranged for selective connection. In one example, the male and female couplings can be conventional snap fasteners. The first and second straps may be utilized to more fully secure the pack to the body of the packer as shown in FIGS. 3, 4 and 5.

Like the shoulder strap, these side straps are also concealed and hidden from view when the pack is in the tote position. It will be appreciated that while a first and a second side strap are exemplified, coupling only one side strap will act to fully secure the first and second enclosures to the body, depending on the user's right or left side attachment preference.

In addition to a balanced pack with evenly distributed weight, this pack design of the present invention allows the user a visible and accessible first enclosure section whereby the user can quickly and easily gain access to articles within the compartments and pouches of the first enclosure, without removing the pack from the shoulder carry position. Additionally, in one aspect, the first enclosure covers a major portion of the chest, protecting that portion of the body from wind or rain, especially comforting when using transportation that is open to the elements such as cycling, skating or the like.

Figure 3:
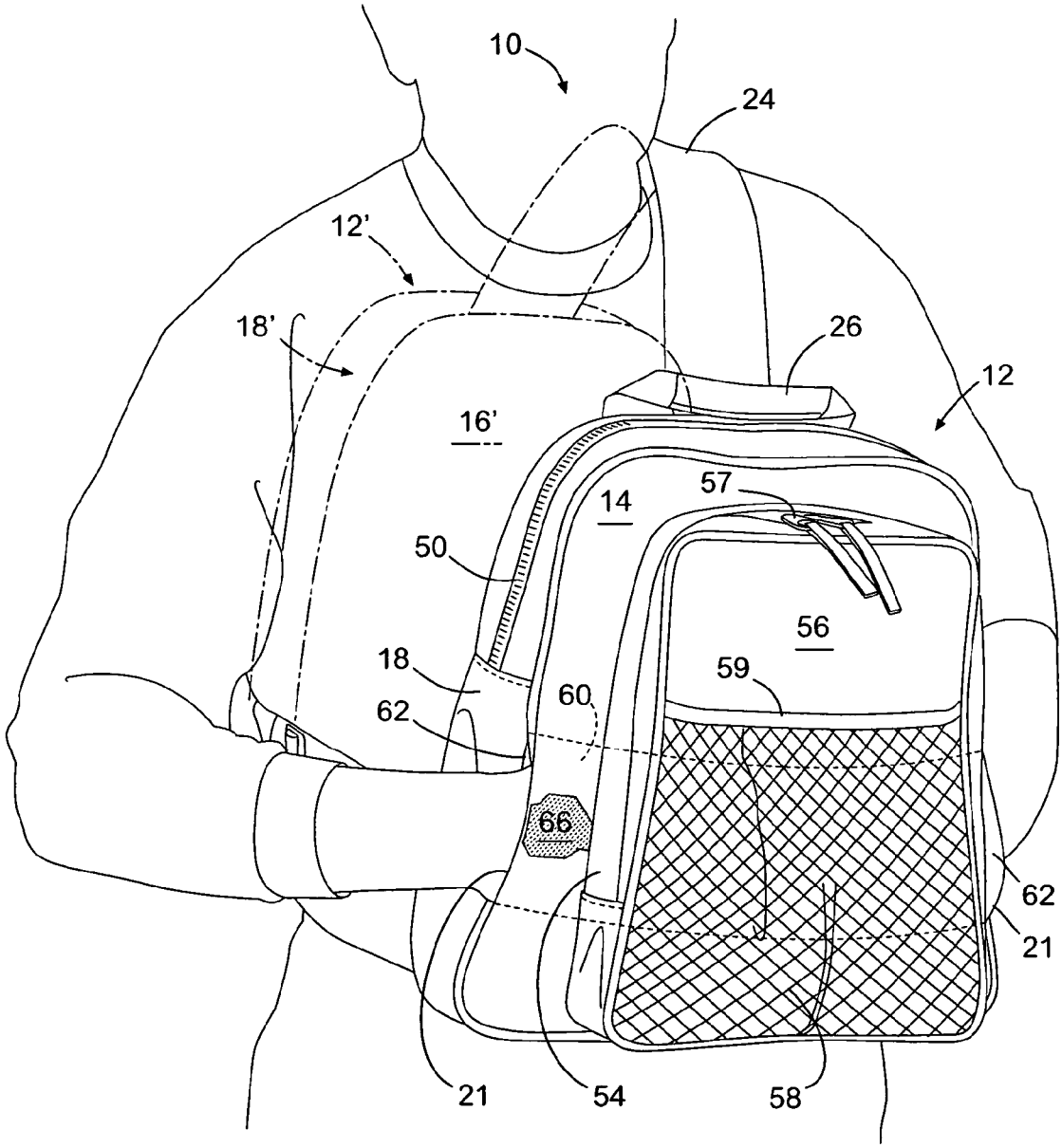
FIG. 3 is a front perspective view of the pack being transported in the shoulder carry configuration with one side strap attached and the packer's hands inserted into the formed pockets on each side of the first enclosure.

Referring now to FIGS. 1-3, the first enclosure 12 consists of the back panel 16 attached by stitching to the side panel 18 which forms the back, top, bottom and sides of the first enclosure. The front panel 14 of the first enclosure is attached to the side panel 18, opposite its attachment to the back panel by, for example, stitching, to complete the first enclosure and to form the first interior cavity 22 therein for placement of articles. In one aspect, the side panel of the first enclosure has a dual zipper 50 positioned at the top and sides of the first enclosure. In another aspect, a smaller side panel 54 is fixed, as by stitching to a portion of the front panel 14 of the first enclosure to form the back, top, bottom and sides of a secondary compartment 52. The opposite edge of side panel 54 is attached or stitched to a front panel 56 to complete the enclosure for the secondary, smaller compartment 52. This secondary compartment is accessible by a dual zipper 57 positioned on the side panel 54 at the top and sides of the secondary compartment 36F. In another aspect, a see through expandable pouch 58 of mesh material is attached to the bottom and side edges of the front panel 56 of the secondary compartment. This pouch has an elastic band 59 extending across its otherwise open top.

In one aspect of the present invention, the pack 10 comprises at least one sleeve 60 that is constructed and arranged for mounting to a respective pair of slits 21 defined in the exterior surface 20 of the first enclosure. In one aspect, the sleeve has two opposed open ends 62. In this aspect, the respective open ends of the sleeve are connected to each respective slit of the pair of slits such that the sleeve 60 is disposed therein the interior cavity 22 of the first enclosure 12. As one will appreciate, the sleeve forms an elongated pocket 66 that is adapted to receive a user's hands.

In another aspect, the at least one sleeve 60 comprises a pair of sleeves 61. Each sleeve 61 has an open end 63 and defines an interior volume. As noted above, the open end of each sleeve is connected to one respective slit of the pair of slits such that each sleeve is disposed therein the first interior cavity 22 of the first enclosure. In this aspect, each sleeve forms a pocket that is adapted to receive a user's hand.

In one example, the formed hand pockets 66 are sewn in a lower portion of the first enclosure 12 at the seam between the side panel 18 and the front panel 14. The at least one sleeve can be lined with an insulating material, such as, for example, fleece to protect and keep the user's hands warm.

As described above, the back panel 16' of the second enclosure of the pack 10 is adapted to cooperate with the opposite back panel 16 of the first enclosure. The side panel 18' of the second enclosure, similar to the first enclosure, is connected by, for example, stitching, at one edge to the back panel 16' to form the top, bottom, sides and back wall of the second enclosure. The front panel 14' of the second enclosure is connected to the side panel of the second enclosure, opposite the front panel to complete the second enclosure. The second interior cavity of the second enclosure accessible by a dual zipper 70 positioned, in one example, on the top and sides of the side panel 18'. In one aspect, attached to the bottom portion 15' of the front panel of the second enclosure are gussets 74, which form the sides of a smaller rear secondary compartment 72. A rear exterior panel 76 is attached to the edges of gussets 74, opposite their attachment with the front panel of the second enclosure. In one aspect, the bottom edge of the rear exterior panel 76 is attached to the bottom edge of panel 14' to form the rear secondary compartment 72. A zipper 78 can be mounted onto a portion of the rear secondary compartment to provide selective access to the volume within the rear secondary compartment 72.

In another aspect, a see through mesh pouch 80 is attached along the bottom and a lower portion of the sides to the rear exterior panel 76 and the gussets 74. This pouch is expandable and has an elastic band 82 mounted to and extending along its otherwise open top. Alternatively, at the top and extending down a portion of the sides along panel 18', is attached a similar see through mesh pouch 84, having a zipper 86 mounted thereon for selective access.

In one aspect, within the volume of the mesh pouch 84, and attached to the exterior surface of the front panel 14' is a loop 90, which is similar to a belt loop, which is constructed and arranged for attachment of a safety light 92. The safety light can be, for example, a conventional battery powered light source and can have a clasp that is constructed and arranged to slip over the loop to secure the light. The light may be fitted with a switch for selectively turning the light on, off, or selecting a slow or fast intermittent light pulses. The surrounding pouch 84 is provided to insure retaining of the light, should it inadvertently become dislocated from the loop 90. In that event, the light 92, would not only be retained but remain visible through the see through mesh material. This light provides a margin of safety for the packer, whether standing, walking, cycling or otherwise. Visibility by motorists is enhanced, especially in low light, or no light environments.

FIG. 5 exemplifies the attached light in conditions of darkness, and dramatically illustrates the enhanced visibility afforded its inclusion. While not illustrated, it is contemplated that a similar safety light can be attached within a sealable mesh pouch on the first enclosure. It will be appreciated that it is contemplated that the safety light can be mounted to any exterior surface portion of the first and/or second enclosure. Alternatively, a reflective material can be attached to any exterior surface portion of the first and/or second enclosure.

As described above, the present invention comprises a pack 10 for carrying articles that can be toted by hand in a conventional manner by an attached handle, or quickly and easily converted to a pack that is carried on the body in a manner that overcomes all of the aforementioned disadvantages of the prior art. In the tote or "hand carry" position, this pack resembles a conventional backpack in that it appears to have a main body portion and a carrying handle. The shoulder strap, externally visible on the conventional backpack, is concealed when the pack is in the tote or unitary position. The main body of the pack 10 of the present invention is bifurcated into two enclosures, i.e., the first and second enclosures, that can be co-joined by conventional complimentary hook and loop fasteners attached to each juxtaposed abutting back panels of the respective first and second enclosures. When the two enclosures are separated, or pulled apart, the central connecting web or shoulder strap is revealed. As noted above, in one aspect, the strap is attached to a top portion of each respective enclosure, much like a saddlebag.

The packs are co-joined together, in the tote or "unitary" configuration, with the back panels of the front and rear enclosures in juxtaposed abutment in a mirror image relationship. Starting with the pack in a tote configuration, the first and second enclosure are pulled apart, separating the hook and loop fasteners, to form the pack 10 that is bifurcated into first and second enclosures, joined by the shoulder strap. The strap is placed over one shoulder with the first enclosure resting on the chest and the second enclosure resting on the back. Only casual care is necessary to the packing of the first and second enclosures, as only an extraordinary disparity in weight would cause the pack to shift on the shoulder from front to back, or back to front. The pack may be shouldered and carried with no further attachment necessary for a casual trip. Additionally, placing one or both hands in the pockets provided in the first enclosure aids in maintaining the position of the pack(s). Under more extreme transports, such as a vigorous walk, run, bicycle ride or the like, one or more of the adjustable side straps can be connected fully secure the pack to the user's body. In extreme situations, both first and second side straps may be coupled.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed herein above, and that many modifications and other aspects are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A pack comprising:

a first enclosure having a front panel, an opposed back panel and a side panel extending therebetween, the first enclosure having an exterior surface and defining a first interior cavity;

a second enclosure having a front panel, an opposed back panel, and a side panel extending therebetween, the second enclosure having an exterior surface and defining a second interior cavity;

a means for mounting the back panel of the first enclosure to the back panel of the second enclosure to form a unitary pack, wherein the means for mounting the back panel of the first enclosure to the back panel of the second enclosure to form a unitary pack are concealed when the first enclosure and the second enclosure form the unitary pack;

a means for supporting the first enclosure such that the back panel of the first enclosure rests on the front portion of a user's body and the back panel of the second enclosure rests on the back portion of the user's body, wherein the means for supporting the first enclosure is formed integral to the first enclosure and the second enclosure, wherein the means for supporting the first enclosure comprises a shoulder strap connected to a portion of the exterior surface of the first enclosure, wherein the shoulder strap extends from the portion of the exterior surface of the first enclosure to a portion of the back panel of the second enclosure and wherein the means for supporting the first enclosure is concealed when the first enclosure and the second enclosure form the unitary pack a first side strap mounted to a lower portion of an exterior surface of the second enclosure, the distal end of the first side strap having a first male coupling mounted thereto;

a first female coupling mounted to a lower portion of the exterior surface of the first enclosure, wherein the first male and female couplings are constructed and arranged for selective connection;

a second side strap mounted to the lower portion of the exterior surface of the second enclosure, the distal end of the second side strap having a second male coupling mounted thereto, wherein the second side strap is mounted on the opposite side of the second enclosure relative to the first side strap;

a second female coupling mounted to the lower portion of the exterior surface of the first enclosure, wherein the second female coupling is mounted on the opposite side of the first enclosure relative to the first female coupling, and wherein the second male and female couplings are constructed and arranged for selective connection; and a third female coupling mounted to the lower portion of the exterior surface of the second enclosure, wherein the third female coupling is mounted on the opposite side of the second enclosure relative to the second side strap, and wherein the third female coupling and the second male coupling are constructed and arranged for selective connection.

2. The pack of claim 1, wherein the exterior surface of the first enclosure defines a pair of slits on a portion of the front panel, and wherein the pack further comprises a pair of sleeves, each sleeve having an open end and defining an interior volume, the open end of each sleeve being connected to one respective slit of the pair of slits such that the pair of sleeves are disposed therein the first interior cavity of the first enclosure, each sleeve forming a pocket adapted to receive the user's hand.

3. The pack of claim 1, wherein the exterior surface of the first enclosure defines a pair of slits on a portion of an edge of the front panel, and wherein the pack further comprises a pair of sleeves, each sleeve having an open end and defining an interior volume, the open end of each sleeve being connected to one respective slit of the pair of slits such that the pair of sleeves are disposed therein the first interior cavity of the first enclosure, each sleeve forming a pocket adapted to receive the user's hand.

4. The pack of claim 2, wherein each sleeve is lined with an insulating material.

5. The pack of claim 1, wherein the first enclosure is selectively openable.

6. The pack of claim 1, wherein the shoulder strap is mounted to a top portion of the first enclosure and a top portion of the back panel of the second enclosure.

7. The pack of claim 1, further comprising a handle mounted to a top portion of the first enclosure.

* * * * *